US005245186A

United States Patent [19]

Chait et al.

[11] Patent Number: 5,245,186

[45] Date of Patent: Sep. 14, 1993

[54] ELECTROSPRAY ION SOURCE FOR MASS SPECTROMETRY

[75] Inventors: Brian T. Chait, New York, N.Y.; Swapan K. Chowdhury, Lebanon, N.J.; Viswanatham Katta, Fort Worth, Tex.; Urooj A. Mirza, New York, N.Y.

[73] Assignee: The Rockefeller University, New York, N.Y.

[21] Appl. No.: 879,035

[22] Filed: May 6, 1992

Related U.S. Application Data

[63] Continuation-in-part of Ser. No. 293,587, Nov. 18, 1991, abandoned.

[51] Int. Cl.[5] ..... H01J 49/04; H01J 49/10

[52] U.S. Cl. ..... 250/288; 250/281

[58] Field of Search ..... 250/288, 288 A, 281, 250/282; 436/123

[56] References Cited

U.S. PATENT DOCUMENTS

| | | | |
|---|---|---|---|
| 4,209,696 | 6/1980 | Fite | 250/288 A |
| 4,531,056 | 7/1985 | Labowsky et al. | 250/288 A |
| 4,641,541 | 2/1987 | Sharp | 250/288 A |
| 4,885,076 | 12/1989 | Smith et al. | 250/288 |
| 4,935,624 | 6/1990 | Henion et al. | 250/288 A |
| 4,977,320 | 12/1990 | Chowdhury et al. | 250/288 |
| 5,015,845 | 5/1991 | Allen et al. | 250/288 A |

*Primary Examiner*—Paul M. Dzierzynski
*Assistant Examiner*—Kiet T. Nguyen
*Attorney, Agent, or Firm*—Wyatt, Gerber, Badie

[57] ABSTRACT

A mass analyzer for the analysis of mass spectra of ions derived from organic molecules includes an electrospray ion source having means to transport the molecules of interest in a solvent of pure water free of organic solvents. The electrospray ion source sprays the water solution, under an imposed voltage, through a metal syringe needle having a sharp etched point and into a conductive capillary tube having a sharpened entrance orifice.

26 Claims, 3 Drawing Sheets

ELECTROSPRAY ION SOURCE FOR MASS SPECTROMETRY

This invention was made with Government support under Grants RR00862 and RR07063 awarded by the National Institutes of Health. The Government has certain rights in the invention.

RELATED APPLICATION

This application is a continuation-in-part application partly based on U.S. patent application Ser. No. 07/793,587, now abandoned, filed Nov. 18, 1991.

FIELD OF THE INVENTION

The present invention relates to mass spectrometry and more particularly to the production of intact high molecular weight ions by electrospray ionization.

DESCRIPTION OF THE RELATED ART

Mass spectrometry is a widely accepted analytical technique for the accurate determination of molecular weights, the identification of chemical structures, the determination of the composition of mixtures and quantitative elemental analysis. It may be employed to determine accurately the molecular weights and structures of organic molecules based on the fragmentation pattern of the ions formed when the molecule is ionized.

Organic molecules having a molecular weight greater than about a few hundred to a few thousand Daltons are of great medical and commercial interest as they include, for example, peptides, proteins, DNA, oligosaccharides, commercially important polymers, organometallic compounds and pharmaceuticals.

It has been suggested that organic molecules, including molecules of molecular weight over 10,000 Daltons, may be analyzed in a quadrupole mass spectrometer using "electrospray" ionization (also known as electrohydrodynamic atomization) to introduce the ions into the spectrometer.

Electrospray is an ionization technique in which intact gas phase ions of involatile and thermally labile biomolecules are produced directly from an analyte solution of interest at atmospheric pressure. Electrospray occurs when a strong electric field is applied to a small flow of a solution of the molecule to be analyzed in a liquid solvent emerging from a fine capillary tube. The strong electric field causes the surface of the emerging solution to become highly charged, resulting in the formation of a fine spray of highly charged droplets. The solvents are evaporated from the droplets as they proceed from atmospheric pressure to the vacuum leading to the formation of gas phase solute ions derived from the organic molecule whose structure and/or molecular weight are to be determined.

The ionization process may produce multiply-charged ions of biopolymers, such as proteins, with high efficiency. These multiply-charged ions result from the attachment of protons and/or cations (e.g. $Na+$) to the acidic or basic sites on the molecule. Because of multiple charging, the mass-to-charge ratios (m/z) of high molecular mass biopolymer ions can be small. For proteins the mass-to-charge ratios typically range between 500–2500. Therefore, conventional mass spectrometers with limited m/z range can be used to analyze large proteins.

In electrospray ionization the capillary tube, typically a metal syringe needle or glass capillary tube, has its exit orifice positioned close (0.5–4 cm) to the entrance orifice of a quadrupole mass spectrometer, see U.S. Pat. No. 4,977,320 to S. Chowdhury, V. Katta and B. Chait, incorporated by reference herein. A dilute solution, containing the molecules of interest, is pumped through the tube. The solvent is generally a mixture of an alcohol, typically methanol, and water. A strong electric potential, typically 3 kv to 6 kv between the exit orifice and the entry orifice leading to the mass analyzer, forms the spray ("electrospray") of the solution.

Since electrospray ionization occurs directly from solution at atmospheric pressure, the ions formed in this process tend to be strongly solvated. Such solvation interferes with accurate spectrometric analysis of the solvated molecule to be analyzed. A typical solvent is 40–45% distilled water, 45–55% purified methanol, and 3–5% acetic acid. To carry out meaningful mass measurements, it is necessary that all such solvent molecules attached to the ions be efficiently removed.

In some situations the solution to be analyzed may be limited in size, for example, because of its difficulty of preparation or the rarity of the original sample. In those situations, and others, it is desirable to have as high an efficiency of usage as possible (to analyze as high a percentage of the total ions produced) so that the solution is not wasted.

OBJECTIVES OF THE INVENTION

It is an objective of the present invention to provide an electrospray ion source for a mass spectrometer that does not use an alcohol, or other organic solvent.

It is a further objective of the present invention to provide such an ion source which will produce an adequate supply of highly charged ions free of solvent from a liquid solution of macromolecules without fragmentation of the ions.

It is a further objective of the present invention to provide such an ion source in which a solution of micron size droplets of pure water (without organic solvents) is sprayed into the atmosphere outside of the vacuum of the mass spectrometer.

It is a further objective of the present invention to provide such an improved electrospray apparatus in which proteins are denatured prior to spraying to provide ions having relatively higher charges.

It is a further objective of the present invention to provide such an improved electrospray apparatus in which the efficiency of introducing ions into the spectrometer is improved so that less of the solution is required and the analysis time may be reduced.

It is a further objective of the present invention to provide such an ion source which will fit on commercial mass analyzers with only minor modifications.

SUMMARY OF THE INVENTION

In accordance with the present invention a modified mass analyzer is connected to a novel electrospray ion source to form a mass spectrometer. The mass analyzer may be a quadrupole, a magnetic deflection, TOF (time-of-flight), Fourier Transform or other type of mass analyzer.

It is desirable to have the ability to electrospray pure aqueous solution, without organic solvents, because many proteins are not soluble in solutions containing a large proportion of organic solvents and because it has been observed that different proteins yield widely different mass spectrometric sensitivities when electrosprayed from solutions containing about 50% methanol.

The ion source includes a metal syringe needle having a high voltage (typically 1-10 kv) imposed upon it and a sharp point. The needle's exit orifice is spaced, in ambient atmosphere of the laboratory, at a distance (0.5-4 cm) from the entrance orifice of a long metal capillary tube, which is at the entry end of the mass analyzer. The capillary tube is heated by an electrical resistance coil and held at a lower voltage (0-400 V). The exit orifice of the capillary tube is separate from a skimmer (a conical nozzle having a central hole therethrough) and is within a vacuum chamber (pressure 1-10 Torr). A hole in the skimmer leads to a second vacuum chamber ($4\times10^{-3}$ Torr), to a series of lenses, each with a hole therethrough, and to a baffle having a hole therethrough and leading to the vacuum chamber ($2\times10^{-5}$ Torr) of the mass analyzer (quadrupole analyzer).

The molecules of interest, for example, a protein, are dissolved in pure water without organic solvents and the water solution is pumped through the syringe needle. The solution is electrosprayed therefrom in micron size droplets into the atmosphere so it may be viewed and adjusted by the user.

In another embodiment of the invention, proteins are denatured by heating the protein solution while it is being pumped from its fluid (solution) reservoir to the spray needle. The rear portion of the spray needle is surrounded by a tightly fitting ceramic sleeve which is heated. The heat of the sleeve is transmitted through the metal needle to the solution and denatures the proteins therein.

In another embodiment the efficiency of the electrospray is improved by increasing the percentage of ions which are sprayed from the spray needle orifice and which reach the interior of the receiving capillary tube. The end of the capillary tube facing the spray needle is sharpened and the sprayed ions tend to follow the electrical field lines from the tip of the spray needle to the sharpened tip of the capillary tube.

BRIEF DESCRIPTION OF THE DRAWINGS

Other objectives and features of the present invention will be apparent from the following detailed description of the present invention, taken in conjunction with the accompanying drawings.

In the drawings.

DESCRIPTION OF THE INVENTION

Figure 1:
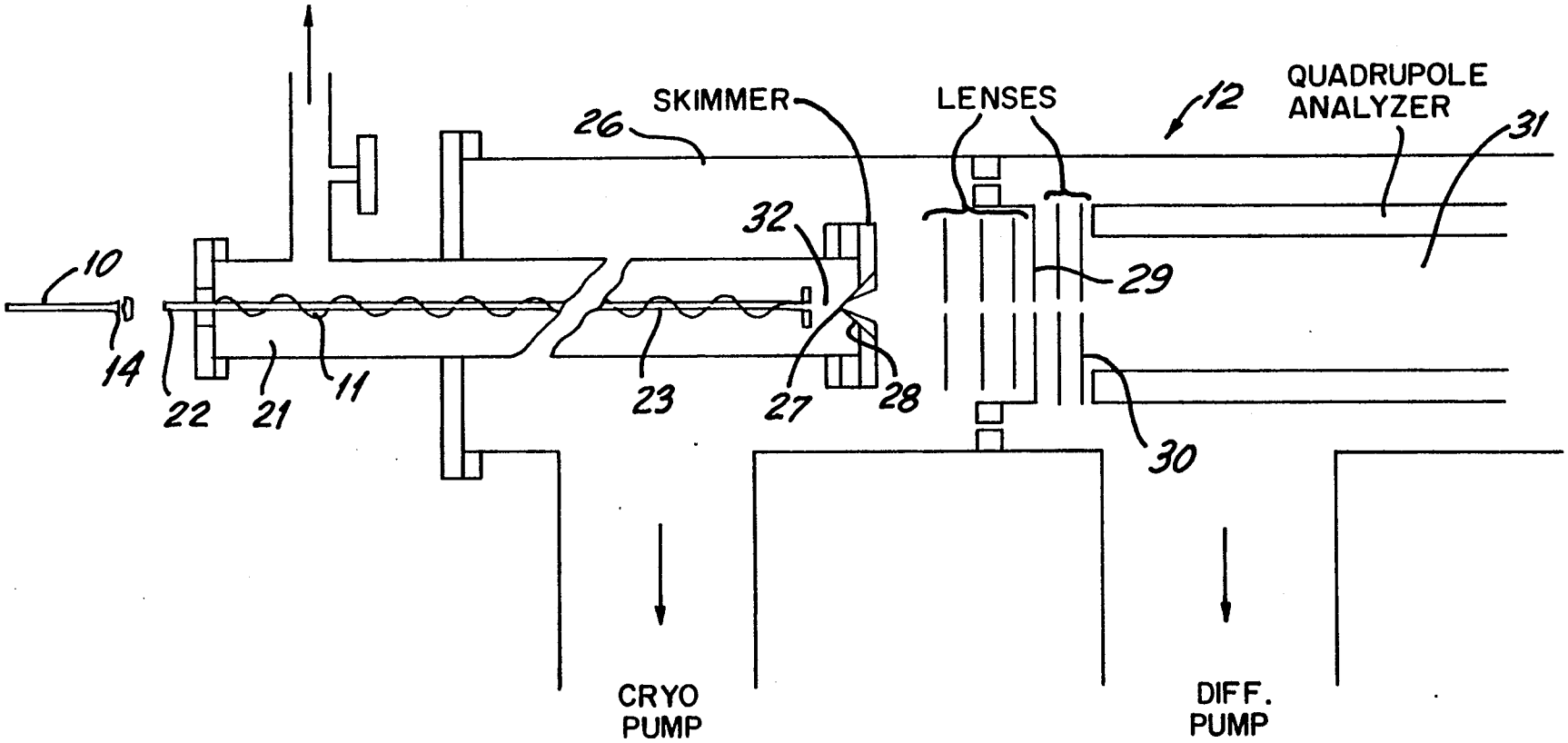
FIG. 1 is a side plan view schematic diagram of the electrospray ionization mass spectrometer (not drawn to scale) of the present invention.

A schematic representation of the electrospray ionization mass spectrometer of the present invention is shown in FIG. 1. The mass spectrometer uses a newly designed electrospray ion source that is plugged directly into a modified commercial quadrupole mass analyzer with the ions entering the mass analyzer through a long capillary tube and three stages of differential pumping.

Figure 2:
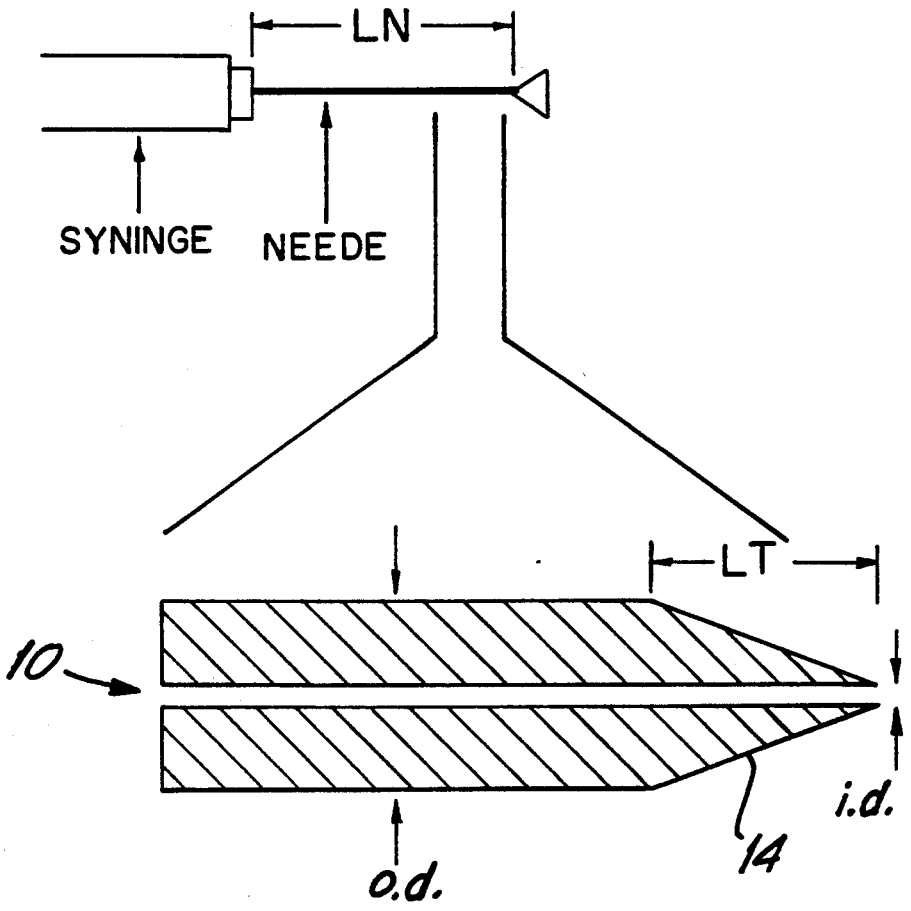
FIG. 2 is an enlarged cross-sectional side view of the syringe needle tip.
Figure 5:
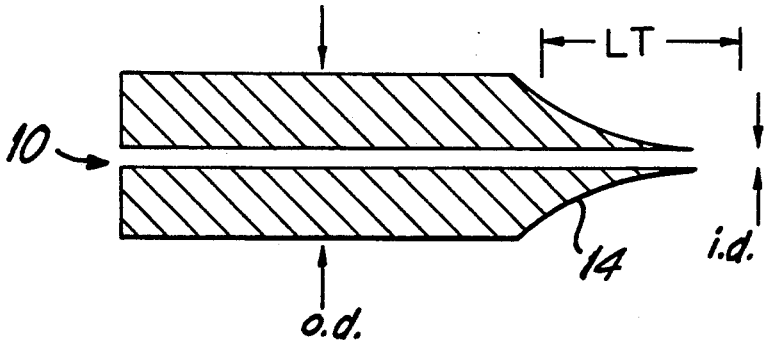
FIG. 5 is an enlarged cross-sectional side view of an alternative embodiment of the syringe needle tip.

The analyte solution is a dilute solution of the molecules of interest in "pure water". The term "pure water", as used herein, means water that has been deionized and distilled. The conductivity of the pure water (distilled water) used is $6\times10^{-4}$ ohms$^{-1}$m. Preferably the needle has an outlet orifice which is a round bore (in cross-section) having an internal diameter (i.d.) of 50 microns to 200 microns, preferably about 150 microns. Its outer diameter is not critical and may be from 100 microns to 1000 microns. The tip 14 of the needle, as shown greatly enlarged in FIG. 2, in one embodiment, is chemically etched at the tip to provide a sharp conical shape. The length of the needle LN is 5 cm, the length of the tip LP is 1000 microns. The outer diameter o.d. is 710 microns and the inner diameter i.d. is 150 microns. Alternatively, a fine bore needle (less than 150 microns) may be used. The thickness of the wall of the needle at its tip (free end), because of the conical sharp point, is very thin (less than 150 microns) and is preferably about 100 microns. The critical element is the small size of the orifice (less than 150 microns) and not the shape of the tip. In the embodiment shown in FIG. 5, the spray needle has an axis 19 and the exterior needle wall is etched in a concave shape proximate the needle tip **14*a* (needle point) in a plane through the axis. A high voltage is impressed on the needle 10** in the range of +1 kv to +10 kv and preferably about +5 Kv. That tip, unexpectedly, permits the spraying of pure water, as the only solvent, without buffers and without alcohol or other organic solvents. However, the water solvent may have acetic acid in the preferred range of 0.2% to 4% by weight, for example, ultra pure acetic acid from I.T. Baker & Co. (Phillipsburg, N.J.). The term "free from organic solvents" means that the solution is free of organic solvents, except it may contain Ph modifiers such as acetic acid or other modifiers, in an amount less than 10% by weight.

Figure 3:
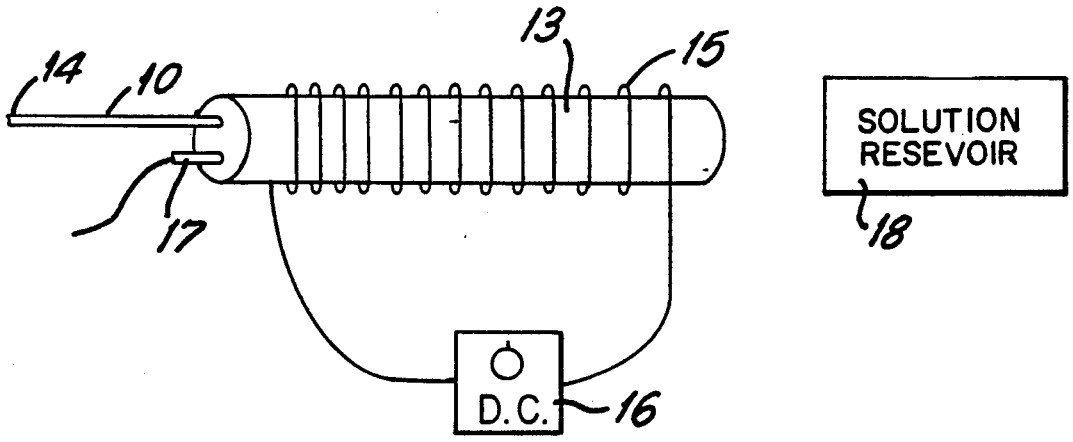
FIG. 3 is a perspective view of the needle heating system.

The analyte solution is heated by a heated needle which is located between the fluid reservoir 18, for the analyte solution, and the exit orifice of the spray needle. The selective and controlled heating of the analyte solution denatures proteins in the solution. Generally, as a result, the denatured protein ions have a higher state of electrical charge, so that the spectrometer has an improved sensitivity to such ions. As shown in FIG. 3, the metal spray needle 10 is encased in a tightly fitting ceramic sleeve (ceramic tube) 13. An electrical resistance heating wire 15, for example of nichrome, is wound about the ceramic sleeve 13 and its two ends connected to a controllable source of DC current 16 to provide current to heat the wire. The heated wire 15 heats the ceramic sleeve 13 which in turn, heats the metal needle 10 therein. The metal needle heats the analyte solution flowing from the fluid reservoir 16 through the needle 10. A thermocouple 17, to measure temperature, is fitted into a hole in the sleeve 13. Preferably the needle is heated in the range of 50° C. to 150° C. and most preferably in the range of 70° C. to 100° C.

The heated needle, illustrated in FIG. 3, may be used with the pure water analyte solution or with conventional water and organic solvent analyte solutions.

Electrospray of the analyte solution produces fine, highly charged droplets. These droplets attempt to follow the electric field lines and migrate toward the metal capillary tube 11. The tube 11 is preferably of stainless steel and 1.59 mm o.d., 0.50 mm i.d., 203 mm length and projects into the first vacuum chamber 21 of the mass spectrometer, see FIG. 1.

Figure 4:
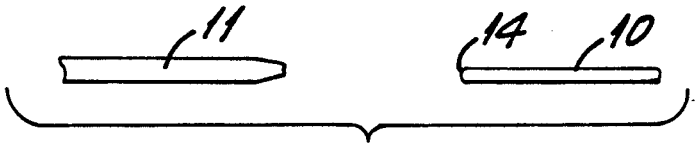
FIG. 4 is a side view (enlarged) of the spray needle and the end of the capillary tube.

The metal capillary tube previously employed had a blunt input orifice 22. However, as shown in FIG. 4, the input orifice 22 is sharpened (tapered) which improves the efficiency of ion introduction. That improvement in efficiency occurs because a higher percentage of the ions sprayed from the needle 14 reach the interior of the capillary tube 11. Ions produced at the exit tip of the spray needle 10 tend to follow the lines of the electrical field between the needle tip 14 and the capillary tube inlet orifice 22. When the capillary orifice 22 is sharpened, as shown in FIG. 3, the electrical field lines tend to converge and focus the ions into the capillary tube inlet orifice 22.

The cross-sectional area of the internal diameter (i.d.) inlet orifice 22 is a fraction, preferably ¼ to ½, of the cross-sectional area of the i.d. of the capillary tube. With a tube of 0.50 mm i.d. (area 0.79 $mm^2$) the area of the inlet orifice is preferably in the range of 0.2 mm to 0.4 mm.

The whole vacuum housing 12 is heated to a temperature of about 100° C. The first vacuum chamber 21 is evacuated by a rotary pump, preferably Edwards ISC 900, pumping speed of 1100 liters l/min to maintain a pressure of 1.2 Torr at the position of a gauge such as the Pirani gauge 20 shown in FIG. 1. A fraction of the migrating droplets enters the long stainless steel capillary tube 11 assisted by the strong flow of gas that results from the large pressure difference between the two ends of the tube 11. Droplets entering into the input orifice 22 of the tube 11 tend to be focused towards the center of the tube 11 by this strong gas flow and are thus transported through the hole.

The tube 11 is heated to preferably about 80° to 150° C. (range of 25°-200° C.) and typically 85° 5° C., by an electric heating tape wound around the tube 11. The heat causes the ionized droplets and solvated ions to undergo continuous desolvation as they pass through the tube 11. The long metal capillary tube 11 transports ionized entities from atmospheric pressures to a chamber 21 of reduced pressure (1-10 Torr). The long tube 11 allows (a) convenient injection of ions into the commercial mass spectrometer system; (b) efficient pumping of the region between the capillary tube exit and the skimmer 28 (conical nozzle); (c) ready visualization of the electrosprayed droplets by the user as they exit from the needle so that adjustments may be made; and (d) efficient and controlled heat transfer to the droplets. The use of metal in the present design reduces charging problems sometimes encountered with glass capillary tubes.

A fraction of the material that emerges from the capillary tube 11 passes into a second vacuum chamber 26 and through a preferably 0.5 mm diameter orifice 27 in a skimmer 28 (conical nozzle) preferably situated 3.3 mm from the exit end of the tube 11. The tube 11 and skimmer 28 are electrically isolated to allow the application of an electric field in the region between them. The ions that exit the capillary tube 11 often have appreciable residual solvation despite the desolvation that takes place in tube 11 and the electric field applied between the capillary tube and the skimmer removes the last of the solvent molecules by collisional activation. The electric field in the region between the skimmer 28 and the capillary tube 11 is controlled by varying the applied voltage on the capillary tube (the voltage on the skimmer is kept constant). At lower voltages desolvation of ions can be achieved, while at higher voltages it is feasible to induce fragmentation of analyte ions. The combined (cumulative) effect of heat and collisional activation provides the total desolvation. The capillary tube 11 is normally heated to a fixed temperature between 80°-150° C. and the voltage on the capillary tube is varied to obtain the highest mass spectrometric response for a given ion. Such an optimization of the response for a given ion is performed by scanning the mass analyzer about a narrow m/z region and monitoring the ion signal of interest on the computer screen.

The second vacuum chamber 26 is differentially pumped by a He-cryogenic pump, preferably Air Products Model AP-6, having a pumping speed of 680 l/s for N to give a vacuum of $4\times10$ Torr. The ions that emerge from the skimmer 28 are focused by a set of lenses into the mass analyzing chamber 31 through a 2.4 mm diameter hole in a baffle 29 that separates this second vacuum chamber 26 from the mass analyzer chamber 31. Beyond the baffle 29, the ions pass through another set of lenses 30 and enter the chamber 31 of the mass analyzer, preferably a quadrupole analyzer, where their mass-to charge ratios (m/z) are determined. The vacuum in the analyzer chamber 31 is held at $2\times10$ Torr by a pump such as an oil diffusion pump, preferably Edwards diffstak-63M, pumping speed of 155 l/s. Following m/Z analysis, as in conventional mass analyzers, the ions are post-accelerated by a potential of between −2200 and −3000 V and are detected by an off-axis electron multiplier.

The combination of controlled heat transfer to the charged droplets during transport through the long capillary tube 11 and collisional activation caused by an electrostatic field 32 in a region of reduced pressure brings about the removal of solvent molecules adhering to the biomolecule ions. This electrostatic field 32 is easily variable and provides a sufficiently fine control of the collisional activation so that at low fields complete desolvation of the molecule ions can be effected without fragmentation, while at high fields dissociation can be effected to give collisional activated dissociation spectra.

The quadrupole mass analyzer, vacuum housing, detector and all lens elements beyond the skimmer may be conventional mass spectrometer components.

The typical and preferred operating voltages are as follows: syringe needle (+5 kv), metal capillary tube (+250 V), skimmer (+18 V), and baffle (0 V). All external flanges and the vacuum housing 12 are at 0 V., i.e., grounded.

Certain spray conditions as a function of spray voltage and flow rate for the electrospray of pure water and an example of electrospray ionization mass spectra of horse heart cytochrome c are set forth in the article by Chowdbury and Chait, "Method for the Electrospray Ionization of Highly Conductive Aqueous Solutions", *Analytical Chemistry*, Vol. 65, No. 15, Aug. 1, 1991, pages 1660-1664, incorporated by reference herein.

What is claimed is:

1. A system for the analysis of the mass spectra of ions derived from organic molecules to be analyzed, comprising:

(a) a mass analyzer having an inlet orifice means to receive ions to be analyzed;

(b) an electrospray ion source operably connected to said mass analyzer and including:

(i) electrospray means to transport a dilute solution of pure water free from organic solvents and containing molecules to be analyzed as a solvent, said electrospray means operable to spray charged micron size droplets of the solution; said electrospray means including a metal syringe needle having a sharp etched point to spray the droplets;

(ii) means to impose a voltage of about 1-10 kv on said needle;

(iii) a capillary tube having an entrance orifice positioned across a gap from said electrospray to receive said charged droplets, said capillary tube having an exit orifice; wherein the capillary tube has an internal cross-sectional area and said capillary tube entrance orifice is electrically conductive and sharpened so that the cross-sectional area of the entrance orifice is less than one-half the internal cross-sectional area of the capillary tube.

(iv) means to impose a voltage on said capillary tube entrance orifice;

(v) a skimmer means to focus the ions and having an inlet and an outlet orifice and being electrically isolated from the capillary tube, said skimmer means inlet orifice being positioned at a distance from the capillary tube exit orifice;

(vi) a first vacuum chamber enclosing the capillary tube exit orifice and the skimmer orifice and first means to create a vacuum therein;

(vii) a second vacuum chamber enclosing the outlet side of the skimmer and the inlet orifice of the mass analyzer and second means to create a vacuum therein.

2. A system as in claim 1 wherein the needle has an axis and the exterior needle wall has an etched concave shape proximate the needle point in a plane through the axis.

3. A system as in claim 1 wherein said mass analyzer is a quadrupole mass analyzer.

4. A system as in claim 1 wherein the voltage imposed on the needle is in the range of about 3-6 KV.

5. A system as in claim 1 wherein the needle has an exit orifice which is positioned from about 0.5 to 4 cm. from the entrance orifice of the capillary tube.

6. A system as in claim 1 wherein said first vacuum means creates vacuum in the range of about 0.1 to 50 Torr.

7. A system as in claim 1 wherein said second vacuum means creates a vacuum in the range of about $1\times10^{-3}$ to $1\times10^{-6}$ Torr.

8. A system as in claim 1 wherein the capillary tube exit orifice is positioned in the range of about 1-10 mm from the skimmer means entrance orifice.

9. A system as in claim 1 wherein said gap between the electrospray means and the capillary tube is in the atmosphere so that the spray may be viewed and adjusted.

10. A system as in claim 1 and further including heating means to controllably heat said needle to denature proteins in the solution being transported therethrough.

11. A system for the analysis of the same spectra of ions derived from organic molecules to be analyzed, comprising:

(a) a mass analyzer having an inlet orifice means to receive ions to be analyzed;

(b) an electrospray ion source operably connected to said mass analyzer and including:

(i) electrospray means to transport a dilute solution containing molecules to be analyzed as solvent, said electrospray means operable to spray charged micron size droplets of the solution; said electrospray means including a metal syringe needle having a sharp point to spray the droplets;

(ii) a capillary tube having an internal cross-sectional area and an entrance orifice, said entrance orifice being electrically conductive and sharpened so that the cross-sectional area of the entrance orifice is less than one-half the internal cross-sectional area of the capillary tube, said capillary tube being tapered proximate said capillary tube entrance orifice, said entrance orifice being positioned across a gap from said electrospray means to receive said charged droplets, said capillary tube having an exit orifice;

(iii) means to impose a voltage on said capillary tube;

(iv) a skimmer means to focus the ions and having an inlet and an outlet orifice and being electrically isolated from the capillary tube said skimmer means inlet orifice being positioned at a distance from the capillary tube exit orifice;

(v) a first vacuum chamber enclosing the capillary tube exit orifice and the skimmer orifice and first means to create a vacuum therein; and (vi) a second vacuum chamber enclosing the outlet side of the skimmer and the inlet orifice of the mass analyzer and second means to create a vacuum therein.

12. A system as in claim 11 wherein said mass analyzer is a quadrupole mass analyzer.

13. A system as in claim 11 wherein the capillary tube has an internal diameter in the range of about 0.2 mm to 1.0 mm.

14. A system as in claim 11 wherein the needle has an exit orifice which is positioned from about 0.5 to 4 cm. from the entrance orifice of the capillary tube.

15. A system as in claim 11 wherein said first vacuum means creates vacuum in the range of about 0.1 to 50 Torr.

16. A system as in claim 11 wherein said vacuum means creates a vacuum in the range of about $1\times10^{-3}$ to $1\times10^{-6}$ Torr.

17. A system as in claim 11 wherein the capillary tube exit orifice is positioned in the range of about 1.0 mm to 3.0 mm from the skimmer means entrance orifice.

18. A system as in claim 11 wherein said gap between the electrospray means and the capillary tube is in the atmosphere so that the spray may be viewed and adjusted.

19. A system for the analysis of the mass spectra of ions derived from organic molecules to be analyzed, comprising:

(a) a mass analyzer having an inlet orifice means to receive ions to be analyzed;

(b) an electrospray ion source operably connected to said mass analyzer and including:

(i) electrospray means to transport a dilute solution containing molecules to be analyzed as solvent, said electrospray means operable to spray charged micron size droplets of the solution; said electrospray means including a metal syringe needle having a point to spray the droplets;

(ii) heating means to controllably heat said needle to denature proteins in the solution being transported therethrough;

(iii) means to impose a voltage on said needle;

(iv) a capillary tube having an entrance orifice positioned across a gap form said electrospray means to receive said charged droplets, said capillary tube having an exit orifice; wherein the capillary tube has an internal cross-sectional area and said capillary tube entrance orifice is electrically conductive and sharpened so that the cross-sectional area of the entrance orifice is less than one-half the internal cross-sectional area of the capillary tube;

(v) means to impose a voltage on said capillary tube;

(vi) a skimmer means to focus the ions and having an inlet and an outlet orifice and being electrically isolated from the capillary tube, said skimmer means inlet orifice being positioned at a distance from the capillary tube exit orifice;

(vii) a first vacuum chamber enclosing the capillary tube exit orifice and the skimmer orifice and first means to create a vacuum therein; and (viii) a second vacuum chamber enclosing the outlet side of the skimmer and the inlet orifice of the mass analyzer and second means to create a vacuum therein.

20. A system as in claim 19 wherein said mass analyzer is a quadrupole mass analyzer.

21. A system as in claim 19 wherein the voltage imposed on the needle is in the range of about 1–10 Kv.

22. A system as in claim 19 wherein the needle has an exit orifice which is positioned from about 0.5 to 4 cm. from the entrance orifice of the capillary tube.

23. A system as in claim 19 wherein said first vacuum means creates vacuum in the range of about 0.1 to 50 Torr.

24. A system as in claim 19 wherein said second vacuum means creates a vacuum in the range of about $1\times10^{-3}$ to $1\times10^{-6}$ Torr.

25. A system as in claim 19 wherein the capillary tube exit orifice is positioned in the range of about 1–10 mm from the skimmer means exit orifice.

26. A system as in claim 19 wherein said gap between the electrospray means and the capillary tube is in the atmosphere so that the spray may be viewed and adjusted.

* * * * *